United States Patent [19]

Crosby

[11] 4,228,991

[45] Oct. 21, 1980

[54] SEAT SPRING ASSEMBLY AND SPRING UNIT

[75] Inventor: Lawton H. Crosby, Lake Bluff, Ill.

[73] Assignee: Morley Furniture Spring Corporation, Lake Bluff, Ill.

[21] Appl. No.: 974,236

[22] Filed: Dec. 29, 1978

Related U.S. Application Data

[63] Continuation-in-part of Ser. No. 942,872, Sep. 15, 1978, abandoned.

[51] Int. Cl.[2] ..... F16F 1/46

[52] U.S. Cl. ..... 267/110; 5/247; 5/255; 267/111

[58] Field of Search ..... 267/86–87, 267/102–112; 5/246–253, 255

[56] References Cited

U.S. PATENT DOCUMENTS

| | | | |
|---|---|---|---|
| 3,210,064 | 10/1965 | Crosby | 267/112 X |
| 3,248,745 | 5/1966 | Gunlock | 5/255 X |
| 3,790,149 | 2/1974 | Crosby | 267/110 |

*Primary Examiner*—Douglas C. Butler

*Attorney, Agent, or Firm*—Hume, Clement, Brinks, William & Olds, Ltd.

[57] ABSTRACT

A seat spring assembly comprising the combination of a sinuous spring band connected between the front and back rails of a furniture seat frame and a rectangular loop, zig-zag wire spring unit rigidly secured to the top of the spring band. A substantially horizontal cushion support section of the unit extends between the front rail and a point approximately three-quarters of the way from front to back rails. The unit introduces torquing compression to the band near the front rail and in the body of the band away from the back rail as a subject is seated.

13 Claims, 8 Drawing Figures

SEAT SPRING ASSEMBLY AND SPRING UNIT

RELATED APPLICATION

This application is a continuation-in-part of application Ser. No. 942,872, filed Sept. 15, 1978, entitled SEAT SPRING ASSEMBLY AND SPRING UNIT, now abandoned.

FIELD OF THE INVENTION

This invention relates in general to furniture seat assemblies. It relates particularly to seat spring assemblies which employ sinuous spring bands of one type or another.

BACKGROUND OF THE INVENTION

Sinuous spring bands have long been used as spring components in furniture seat frames. They were developed as a much less expensive alternative to traditional drop in or hand tied coil springs. In addition to being less expensive than coil springs, sinuous bands actually have a longer service life since coil spring constructions inherently utilize biodegradable material such as twine which deteriorates after a number of years. With these advantages came marked disadvantages, however. Principal among these is the fact that plain sinuous spring bands brought with them less comfortable seating than coils.

SUMMARY OF THE INVENTION

An object of the present invention is to provide an improved seat assembly employing sinuous spring bands. Another object is to provide a seat spring assembly employing sinuous spring bands wherein the quality and comfort of the seat is comparable to that of hand-tied coil spring constructions. Still another object is to provide a sinuous band seat spring assembly which produces a greatly improved cushion platform. A further object is to provide a sinuous band seat spring assembly including a new and improved cushion platform unit which cooperates with the band in a new and unexpected way to produce band compression in the body of the band with concomitant added uplift and seat luxury.

The foregoing and other objects are realized in accord with the present invention by providing a furniture seat incorporating spring assemblies wherein sinuous spring bands span the (front to back) rails of the seat frame in regularly spaced relationship. The bands are pre-loaded to oppose downward movement when a subject is seated, either by using normally arcuate bands stretched between the rails, by using normally de-arced bands and compressing them longitudinally to arc them upwardly before fixing their opposite ends to the rails, or by employing separate spring biasing means or the like to apply an upward load on a normally de-arced band. The bands are connected to the front rail in a conventional manner by rail clips, for example. They are connected to the back rail by any one of several rail connector assemblies which may permit downward translation of the back ends of the bands as a subject is seated and might also incorporate torque inducing members or band end configurations.

Surmounting the sinuous band in each spring band assembly is a rectangular loop, zig-zag wire unit incorporating downward bends at each of its opposite ends into ramp folds. The unit is secured to the conventional sinuous spring bands at those ramp fold ends. The free end of the front ramp fold in the zig-zag spring unit is clamped to the conventional sinuous so that the forwardmost point of the ramp fold is directly over the front surface of the front rail. The free end of the back ramp fold in the unit is clamped to the conventional sinuous so that its ramp fold overlies the conventional sinuous approximately three-quarters of the distance from the front rail to the back rail.

The zig-zag spring unit, which includes a rectangular, coil-like spring, provides a level cushion platform for the seat cushion in the furniture seat. Its construction is also effective to produce torque induced compression in the sinuous spring band adjacent the front rail and also at the aforementioned position approximately three-quarters of the distance from the front rail to the back rail. The compression is produced in the band as a subject is seated on the seat spring assembly and is effective to provide dramatic uplift (additional to any torque induced compression at the back rail producing uplift by leverage means such as disclosed in U.S. Pat. No. 3,210,064 and U.S. Pat. No. 3,388,904, for example) in the spring assembly as the subject rises.

BRIEF DESCRIPTION OF THE DRAWINGS

The invention, including its construction and method of operation, together with additional objects and advantages thereof, is illustrated more or less diagrammatically in the drawing, in which.

DESCRIPTION OF THE PREFERRED EMBODIMENTS

Figure 1:
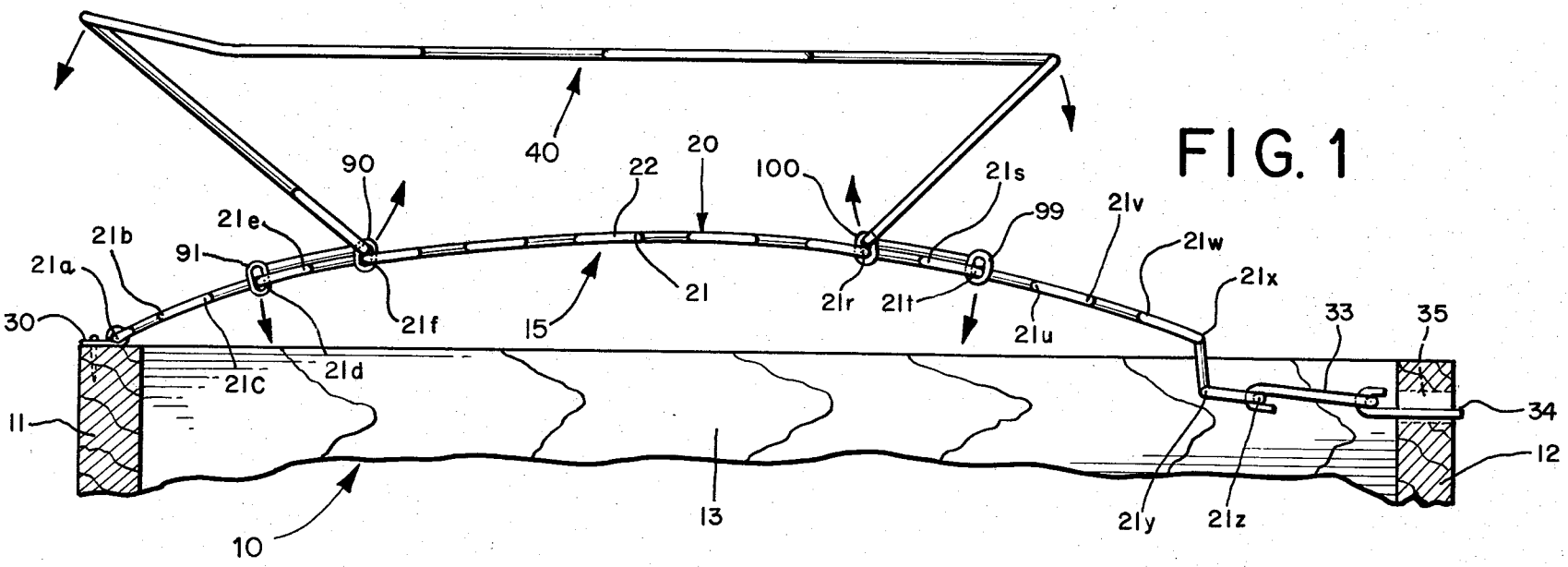
FIG. 1 is a side elevational view of a furniture seat including a first form of seat spring assembly and a zig-zag spring unit embodying features of the present invention.

Referring now to the drawing and particularly to FIG. 1, a portion of a furniture seat is seen generally in 10. The furniture seat 10 includes a front rail 11 and a back rail 12 interconnected by side rails 13 (only one shown), each of the rails being fabricated of wood (steel or plastic may be used as an alternative) and assembled in a conventional manner. According to the invention, the rails 11–13 are of the relatively low profile type normally associated with furniture seats employing coil springs. The significance of this fact will hereinafter be discussed.

Mounted between the front and back rails 11 and 12, and parallel to its side rails 13, are a series of seat spring assemblies 15 embodying features of a first form of the invention (only one shown). In a significant departure from the prior art, the seat spring assembly 15 utilizes a sinuous spring band 20 as its major spring component yet mounts the assembly on the relatively low profile rails 11–13 normally associated with coil springs; thus, making such rails interchangeably usable with the assembly 15 of the present invention as well as with coil springs, for example.

In the illustrated seat spring assembly 15 the sinuous spring band 20 is of a normally arced, X-L configuration. As such, the band includes a plurality of parallel linear wire segments 21 spaced one and one-eighth inches apart and interconnected by generally semi-circular wire segments 22. The band 20 is normally in an arced configuration which, in use, is stretched out to the profile illustrated in FIG. 1 and secured to the rails 11 and 12.

As will hereinafter be discussed, however, it is contemplated that a seat spring assembly 15 embodying features of the invention might also incorporate de-arced springs mounted in such a manner as to force them into an arced configuration. Another alternative is to utilize de-arced springs which are not forced into an arced configuration by the manner in which they are mounted but have secondary spring means or the like which bias them upwardly against the downward movement of a subject being seated. In addition, the springs might be regular or super loop sinuous or the like.

In the assembly 15, the sinuous spring band 20 is pivotally mounted on the front rail in a conventional EK clip 30. The forwardmost linear segment 21*a* of the sinuous spring band 20 seats in the clip 30 in a well-known manner.

The spring band 20 is pivotally connected to the back rail 12 in a manner considerably more sophisticated than that at the front rail. In addition, in the first form of the invention illustrated herein, the configuration of the back end of the spring band 20 is modified to introduce torque at the back end of the band in a manner discussed in the aforementioned U.S. Pat. No. 3,388,904 assigned to the same assignee as the present invention.

Specifically, spring band 20 is bent downwardly at the third linear segment 21*x* from the back end of the band to form, with the body of the band, an interior angle of approximately 120° with the band in place. The band 20 is then bent horizontally outwardly again at the second linear segment 21*y* from its back so that the ultimate linear segment 21*z* is positioned as illustrated in FIG. 1. This ultimate linear segment 21*z* is then connected to the back rail 12 by a pair of swing anchors 33 and 34 in the manner illustrated at FIG. 4 in U.S. Pat. No. 3,790,149, also assigned to the same assignee as the present invention. It will be seen that the swing anchor 34 is connected to the back rail 12 by being seated through a pair of gang bored holes 35 formed horizontally through the back rail.

Figure 2:
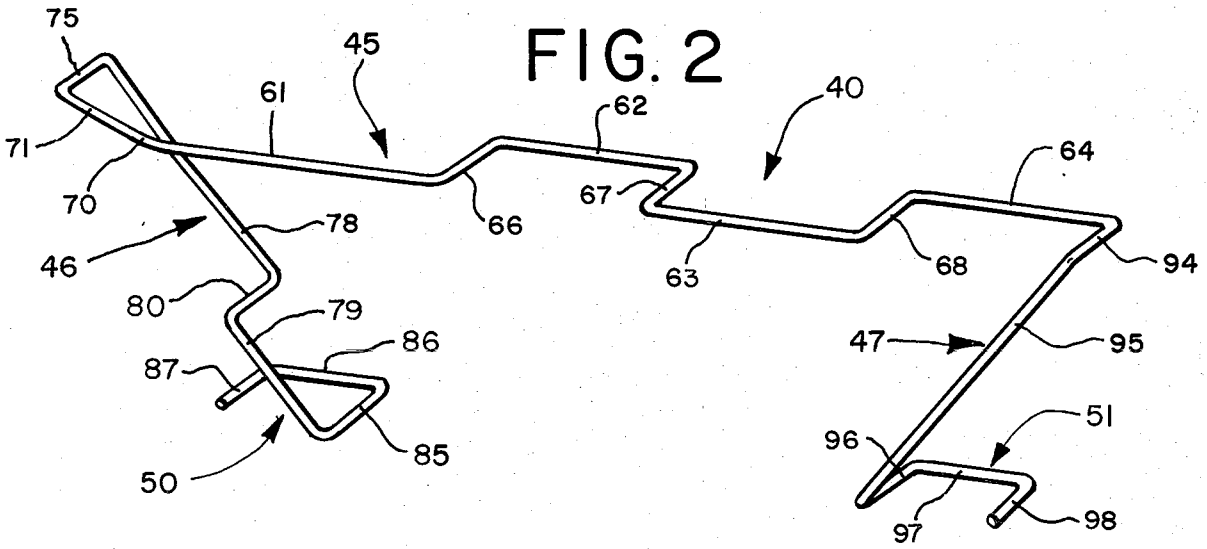
FIG. 2 is a perspective view of the zig-zag spring unit illustrated in FIG. 1.

According to the invention a zig-zag spring unit 40, seen separately and in perspective in FIG. 2, is clamped to the top of each sinuous spring band 20 and cooperates with the band 20 to produce totally unexpected and advantageous results. In addition to affording the seat a level platform for supporting a cushion while using sinuous spring bands rather than coil springs, for example, the spring units 40 act on and with the sinuous spring bands 20 to introduce a downward thrust and torquing effect immediately inwardly of the front rail 11 and substantially inwardly of the back rail 12 whereby longitudinal compression of the band 20 takes place as a subject is seated and subsequent uplift occurs throughout the entire length of the band 20, as well as at the back end where it is provided by the torquing bends between the linear segments 21*x* and 21*z* of the band.

Referring specifically to FIG. 2, the zig-zag spring unit 40 comprises an irregularly formed, single piece of approximately seven gauge spring steel wire. The wire unit 40 includes a substantially horizontal section 45, and downwardly and inwardly extending ramp sections 46 and 47 at its front end back ends, respectively. Each of the ramp sections 46 and 47 has, in turn, a slightly downwardly inclined, as well as outwardly extending attachment section formed at its lower end, the attachment section 50 being formed at the lower end of the ramp section 46 and the attachment section 51 being formed at the lower end of the ramp section 47.

The substantially horizontal wire section 45 comprises four relatively long longitudinal segments 61, 62, 63, and 64 interconnected by three, short, parallel segments 66, 67, and 68. The length of the wire section 45 overall is approximately three quarters that of the distance between the center lines of the front and back rails. While the segments 62–64 and 66–68 are co-planar, the segment 62 has an upward bend in it at 70 so that a forwardmost portion 71 is inclined slightly upwardly.

The forwardmost portion 71 of the horizontal wire section 45 is formed unitarily with the ramp section 46 and connected thereto by a common horizontal wire segment 75 disposed paralel to the segments 66–68 hereinbefore discussed. The ramp section 46 comprises two relatively long longitudinal wire segments 78 and 79 interconncted by a short segment 80 parallel to the common horizontal segment 75. The length of the ramp section 46 is approximately one-third of the length of the horizontal section 45 and is inclined downwardly and inwardly at an angle of 35 degrees from the plane of the segments 66–68 and 62–64.

At the lower end of the ramp section 46 the foot, or attachment, section 50 is formed unitarily with it. A common horizontal wire segment 85 disposed parallel to the segments 66–68 and 75 hereinbefore discussed interconnects the foot section 50 to the ramp section 46.

The foot section 50 comprises a single, longitudinally extending wire segment 86 and a single transversely extending segment 87 parallel to the segment 85. The foot section 50 is, as best illustrated in FIG. 1, formed slightly downwardly from the plane of the main wire section 45 in such a manner that it normally follows the path of the downwardly inclined sinuous spring band 20 at this point.

The foot section 50 of the zig-zag spring unit 40 is clamped to the sinuous band 20 by conventional sleeve clamps 90 and 91. The clamp 90 rigidly secures the wire segment 87 of the foot section to the fourth linear segment 21*d* from the front end of the spring band 20. The clamp 91 rigidly secures the common wire segment 85 to the sixth linear segment 21*f* of the band 20.

The back end of the horizontal wire section 45 is formed unitarily with the ramp section 47 and connected thereto by a common horizontal wire segment 94 disposed parallel to the segments 66–68 hereinbefore discussed. The ramp section 47 comprises a single relatively long longitudinal wire segment 95. The length of the ramp section 47 is approximately one-fourth of the length of the horizontal section 45 and is inclined downwardly and inwardly at an angle of 45 degrees from the plane of the segments 66–68 and 62–64.

At the lower end of the ramp section 47 the foot, or attachment, section 51 is formed unitarily with it. A common horizontal wire segment 96 disposed parallel to the segments 66–68 and 94 hereinbefore discussed interconnects the foot section 51 to the ramp section 47.

The foot section 51 also comprises a single, longitudinally extending wire segment 97 and a single transversely extending segment 98 parallel to the segment 96. The foot section 51 is, as best illustrated in FIG. 1, also formed slightly downwardly from the plane of the main wire section 45 in such a manner that it normally follows the path of the downwardly inclined sinuous spring band 20 at this point.

The foot section 51 of the zig-zag spring unit 40 is clamped to the sinuous band 20 by conventional sleeve clamps 99 and 100. The clamp 99 rigidly secures the wire segment 98 of the foot section 51 to the seventh linear segment **21*t* from the back end of the spring band 20. The clamp 100 rigidly secures the common wire segment 96 to the ninth linear segment 21*r* of the band 20**.

In operation of the seat spring assembly 15, it is mounted in a seat frame in the manner hereinbefore discussed. Frames which have been fabricated for use with coil springs can readily be utilized. In other words, coil spring frames which normally have lower profile rails than those employed with conventional sinuous seat spring assemblies are ideally suited for mating with assemblies embodying features of the present invention because the zig-zag unit 40 is superimposed on top of the sinuous band 20 to give the assembly the depth of a coil spring assembly.

With the assembly 15 mounted as described the section 45 of each assembly in the seat 10 provides a level, horizontal platform for supporting a cushion. The slight upward incline of the portion 71 in wire segment 62 prevents any cushion gap from appearing.

With the cushion in place, when a subject is seated, the zig-zag unit first tends to compress downwardly. In doing so, as illustrated by the arrows in FIG. 1, the foot sections are introducing a torquing effect in the body of the band 20 at the locations indicated. The torquing interaction between the foot sections and the sinuous band or foundation is entirely unique to this invention, and is not found in any zig-zag type spring now extant. This produces band 20 compression adjacent the front rail 11 and substantially inwardly of the back rail 12. This compression resiliently resists downward movement of the band 20 under load and produces a pronounced uplift when the subject rises.

In the spring assembly 15 the configuration of the back end of the band also produces torque compression in the band 20 immediately adjacent the back rail 12, as previously discussed. This torque compression in combination with that produced by the zig-zag spring unit 40 results in greatly enhanced deep-drop and uplift under the seated subject.

Figure 3:
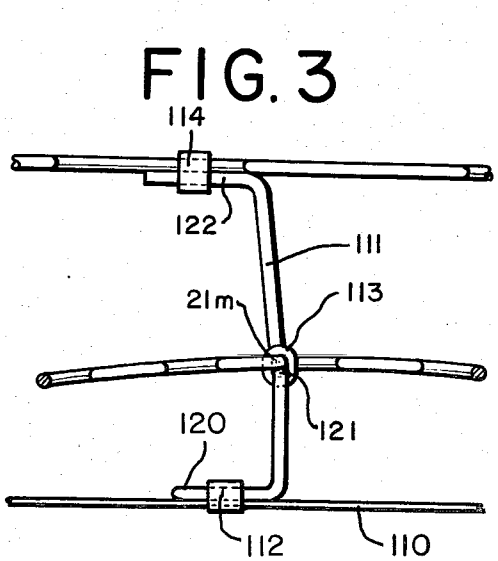
FIG. 3 is a side elevational view, with parts removed, of a modified form of the seat spring assembly illustrated in FIG. 1.

In practice, a plurality of the seat spring assemblies 15 are regularly spaced between side rails 13. The endmost assembly 15 on each end is then modified as illustrated in FIG. 3.

Specifically, a relatively rigid piece of paper covered wire 110 is stretched horizontally between rails 11 and 12 and rigidly fastened thereto. A vertically oriented, rigid, paper covered wire key 111 is then clamped to the wire 110 by a sleeve clamp 113, and to the zig-zag unit 40 by a sleeve clamp 114.

The vertical key 111 is irregularly shaped to have a horizontal lower foot 120 extending longitudinally of the wire 110, to which it is clamped. Intermediate its vertical extremeties the key 111 has a transversely extending, horizontal offset 121, to which a linear segment **21*m* of the band 20 is clamped. An upper horizontal foot 122 of the key 111 is parallel to the lower foot 120 and is clamped to the segment 62 of the section 45 in the unit 40**.

The horizontal wire 110 serves to vertically support the band 20 and the zig-zag unit 40 through the key 111 in each of the outermost seat spring assemblies 15. Downward movement of these assemblies under load is greatly limited. This prevents "lean-out" as the subject is seated.

In practice all of the zig-zag units 40 are tied together around their outermost periphery by a border wire clamped to them in a well-known manner. Lateral stabilization of the spring assemblies 15 relative to each other is further maintained by wire cross ties clamped in a conventional manner to the sinuous bands in transversely extending relationship.

Figure 4:
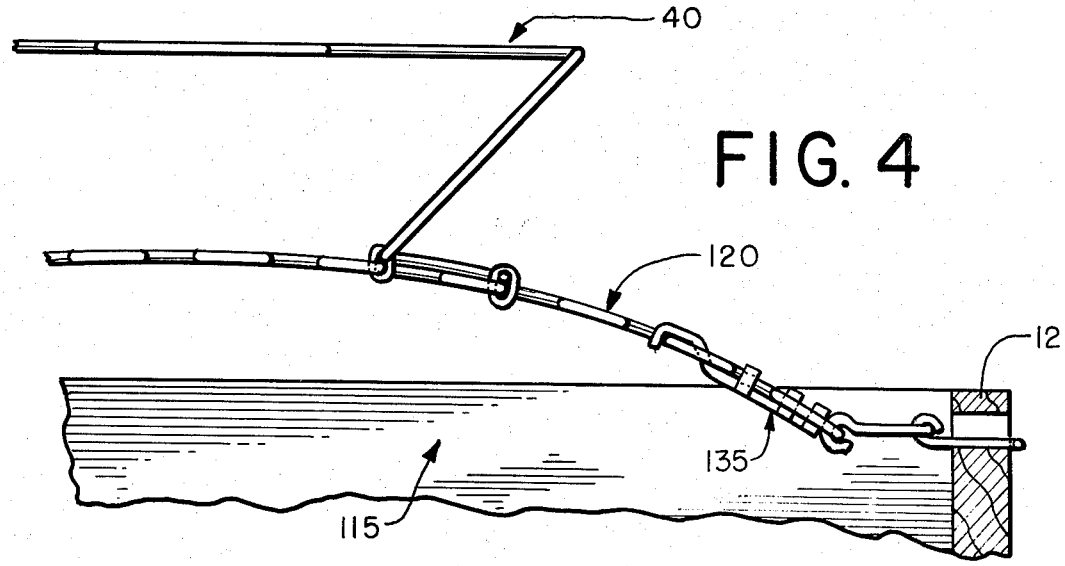
FIG. 4 is a view similar to FIG. 1 of a second form of seat spring assembly embodying features of the present invention.

Referring now to FIG. 4, a seat spring assembly 115 embodying features of a second form of the invention is mounted between front and back seat frame rails 11 and 12 (only back shown). In the assembly 115, the sinuous spring band 120 is again pivotally mounted on the front rail in a conventional EK clip. The forwardmost linear segment of the sinuous spring band 120 seats in the clip in a well-known manner.

The spring band 120 is also pivotally connected to the back rail 12 in a manner considerably more sophisticated than that at the front rail. The back end of the spring band 120 is connected to the rail 112 through a torsion bar 135 in the manner disclosed generally in U.S. Pat. No. 3,210,064 assigned to the same assignee as the present invention. The bar 135 attachment is made through a pair of swing anchors 133 and 134 in a manner similar to that shown in FIG. 1, however.

According to the invention a zig-zag spring unit 40 such as seen in FIG. 2 is clamped to the top of each sinuous spring band 120 and cooperates with the band 120 to produce unexpected and advantageous results similar to those described with regard to the first form of the invention. In addition to affording the seat a level platform for supporting a cushion while using sinuous spring bands rather than coil springs, the spring units 40 act on and with the sinuous spring bands 120 to introduce a downward thrust and torquing effect immediately inwardly of the front rail 11 and substantially inwardly of the back rail 12 whereby longitudinal compression of the band 120 takes place as a subject is seated and subsequent uplift occurs throughout the entire length of the band 120 as well as at the back end where it is provided by the torsion bar 135.

The torsion bar 135 at the back end of the band 120 produces torque compression in the band immediately adjacent the back rail 12. This torque compression in combination with that produced by the zig-zag spring unit 40 results in greatly enhanced deep-drop and uplift under the seated subject.

Figure 5:
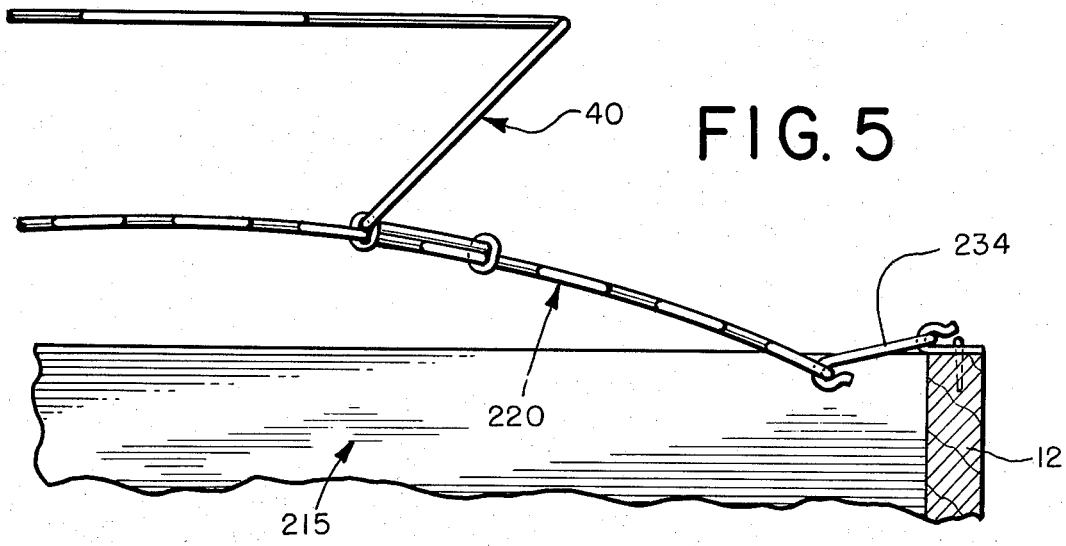
FIG. 5 is a view similar to FIG. 1 of a third form of seat spring assembly embodying features of the present invention.

Third and fourth forms of the seat spring assemblies embodying features of the present invention are illustrated in FIGS. 4 and 5. In the seat spring assembly 215 illustrated in FIG. 5, the spring band 220 is surmounted by a platform unit 40 identical to that illustrated in FIG.

3. However, the band 220 does not have a torque component at its back end. The back end of the band 220 is connected to the back rail 12 by a swing anchor 234.

Thus the single action torquing effect of the platform unit 40 is present, but the combination torquing produced by the band bends in the first form of the invention and the torsion bar in the second form of the invention are not utilized. This third form of the seat spring assembly 215 embodying features of the invention is, of course, less expensive to manufacture. It would be utilized in a slightly lower price line of furniture.

Figure 6:
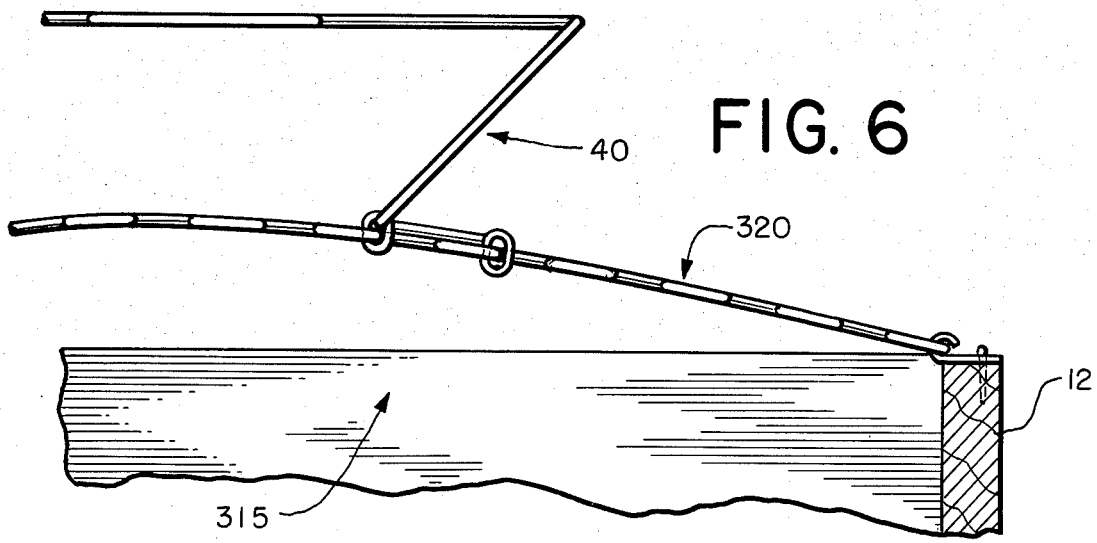
FIG. 6 is a view similar to FIG. 1 of a fourth form of seat spring assembly embodying features of the present invention.
Figure 7:
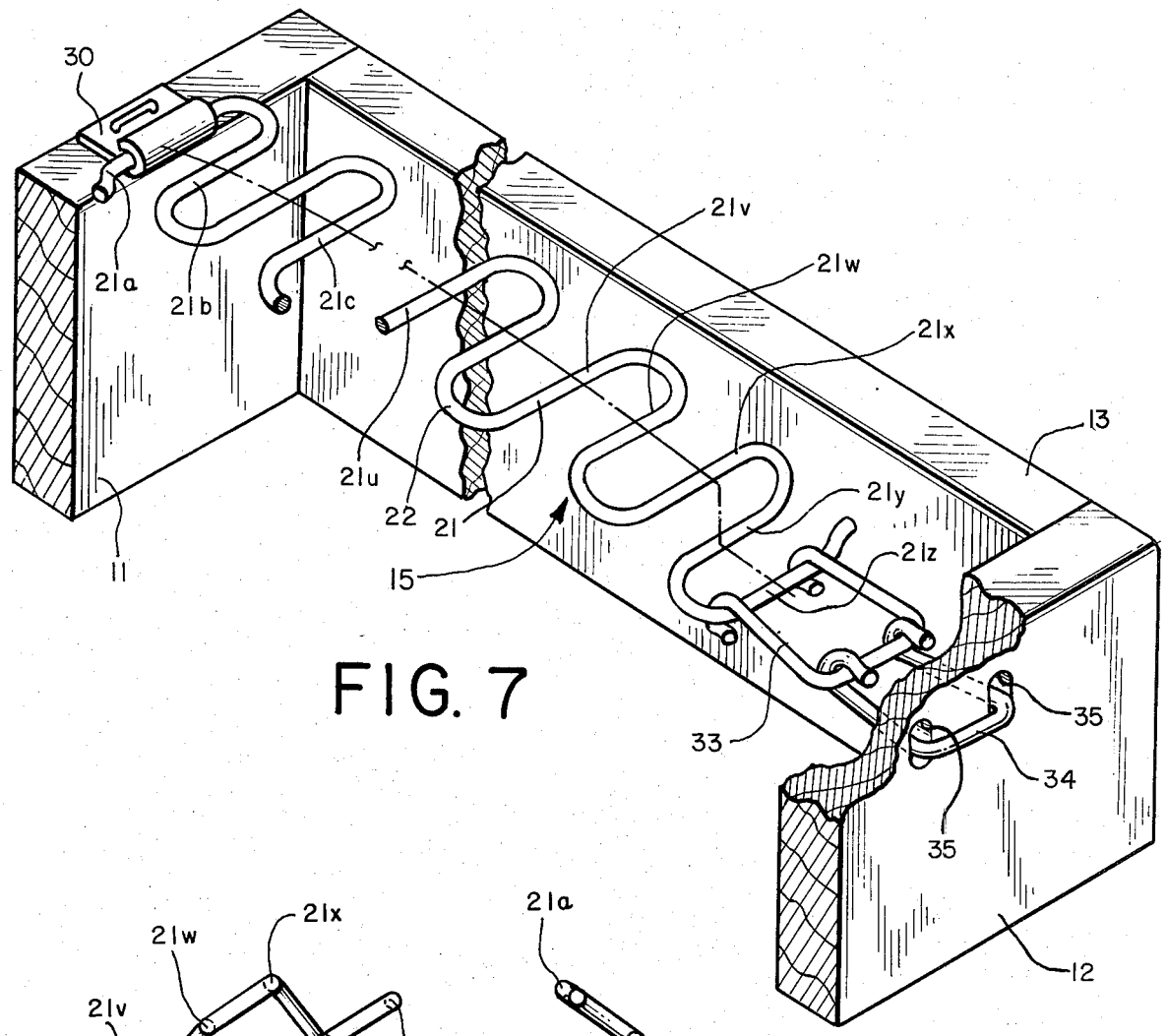
FIG. 7 is a perspective view of the seat portion illustrated in FIG. 1, with parts broken away.
Figure 8:
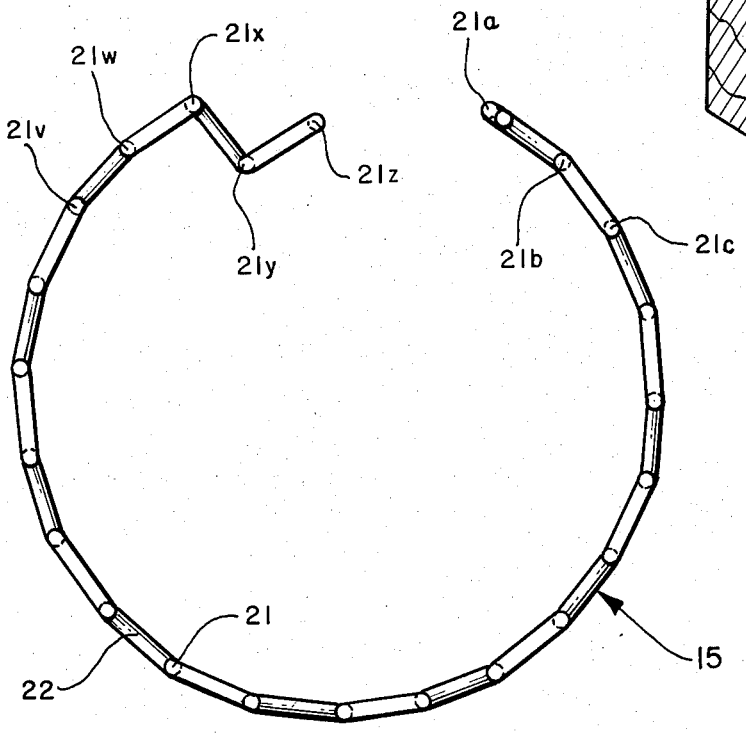
FIG. 8 is a side elevational view of a normally arced sinuous spring band, in its relaxed condition.

The fourth form of the seat spring assembly 315 illustrated in FIG. 6 is similar to the third form illustrated in FIG. 5 except that the sinuous spring band 320 is connected for simple pivoting movement to the back rail 12. No articulation of the band 320 connection to the back rail is employed so an even more rudimentary and less expensive structure is produced. The single action torquing of the platform unit 40 is present and produces the single torque action hereinbefore discussed.

While several embodiments described herein are at present considered to be preferred, it is understood that various modifications and improvements may be made therein, and it is intended to cover in the appended claims all such modification and improvements as fall within the true spirit and scope of the invention.

What is desired to be claimed and secured by Letters Patent of the United States is:

1. A furniture seat, comprising:

a seat frame having front and back rails;

a seat spring assembly furniture seat mounted between the front and back rails;

said spring assembly including a sinuous spring band connected at its front end to the front frame rail and at its back end to the back frame rail;

said spring band being biased upwardly by means associated with the band; and a zig-zag wire unit fastened to said sinuous spring band and extending upwardly therefrom;

said zig-zag wire unit including a substantially horizontal wire section for supporting a cushion and including means effective to introduce torquing forces in said band adjacent the front end of the band and at a point removed from the back end of the band but more than half of the distance between the front seat frame rail and the back seat frame rail.

2. The furniture seat of claim 1 further characterized in that:

said sinuous spring band includes a plurality of linear wire segments interconnected by a plurality of generally semicircular wire segments; and said zig-zag wire unit includes a front foot section and a back foot section with each of said foot sections fastened to said linear segments of said spring band.

3. The furniture seat of claim 2 further characterized in that:

each of said foot sections is attached to said spring band by being anchored to at least two linear wire segments of said spring band.

4. The furniture seat of claim 3 further characterized in that:

said front foot section is attached to two linear segments of said sinuous spring band displaced at least three linear segments from the front end of said spring band.

5. The furniture seat of claim 3 further characterized in that:

said back foot section is attached to two linear segments of said spring band displaced at least five linear segments from the back end of said spring band.

6. The furniture seat of claim 2 further characterized in that:

said zig-zag wire unit includes a substantially horizontal section having a front ramp section formed downwardly and rearwardly from a common wire segment joining them;

said common wire segment being disposed in substantially vertical alignment with the front surface of the front rail in the furniture seat.

7. The furniture seat of claim 6 further characterized in that:

said zig-zag wire unit includes a back ramp section formed downwardly and forwardly from a common wire segment joining them.

8. The furniture seat of claim 6 further characterized in that:

said front ramp section forms an internal angle of approximately 30° from said substantially horizontal section.

9. The furniture seat of claim 6 further characterized in that:

said back ramp section forms an internal angle of approximately 35° from said substantially horizontal section.

10. A wire unit for attachment to a sinuous spring band in a furniture seat spring assembly, comprising:

a substantially horizontal wire section formed in a rectangular loop, zig-zag pattern, and including a plurality of longitudinally extending wire segments interconnected by a plurality of transversely extending wire segments;

a front ramp section joined to said substantially horizontal wire section by a common transverse wire segment and extending back underneath said horizontal section at an interior angle of less than 90° from said horizontal section;

a back ramp section joined to said substantially horizontal wire section by a common transverse wire segment and extending back underneath said horizontal section at an interior angle of less than 90° from said horizontal section;

a front foot joined to the lower end of said front ramp section by a common transverse wire segment; and a back foot section joined to the lower end of said back ramp section by a common transverse wire segment.

11. The wire unit of claim 10 further characterized in that:

said front ramp section is disposed at one interior angle from said horizontal section;

another interior angle greater than said one angle being formed between said horizontal section and said back ramp section.

12. The wire unit of claim 10 further characterized in that:

said one angle is approximately 30° and said other angle is approximately 35°.

13. The wire unit of claim 10 further characterized in that:

each of said foot sections is inclined downwardly at a slight angle to the horizontal section.

* * * * *